US006942029B2

(12) United States Patent
Simpson

(10) Patent No.: US 6,942,029 B2
(45) Date of Patent: Sep. 13, 2005

(54) TUBING EXPANSION

(75) Inventor: Neil Andrew Abercrombie Simpson, Aberdeen (GB)

(73) Assignee: Weatherford/Lamb Inc., Houston, TX (US)

( * ) Notice: Subject to any disclaimer, the term of this patent is extended or adjusted under 35 U.S.C. 154(b) by 0 days.

(21) Appl. No.: 10/313,268

(22) Filed: Dec. 6, 2002

(65) Prior Publication Data

US 2004/0007364 A1 Jan. 15, 2004

(30) Foreign Application Priority Data

Dec. 6, 2001 (GB) ..... 0129193

(51) Int. Cl.[7] ..... E21B 33/128
(52) U.S. Cl. ..... 166/207; 166/217; 166/380
(58) Field of Search ..... 166/212, 217, 166/207, 208, 380, 382, 387

(56) References Cited

U.S. PATENT DOCUMENTS

| | | | | |
|---|---|---|---|---|
| 5,787,933 A | | 8/1998 | Russ et al. | 138/98 |
| 6,098,717 A | | 8/2000 | Bailey et al. | 166/382 |
| 6,425,444 B1 | * | 7/2002 | Metcalfe et al. | 166/387 |
| 6,457,532 B1 | * | 10/2002 | Simpson | 166/380 |
| 6,497,289 B1 | * | 12/2002 | Cook et al. | 166/380 |
| 6,622,797 B2 | * | 9/2003 | Sivley, IV | 166/380 |
| 6,702,029 B2 | * | 3/2004 | Metcalfe et al. | 166/378 |

FOREIGN PATENT DOCUMENTS

| | | | |
|---|---|---|---|
| GB | 2345308 A | 7/2000 | E21B/43/10 |
| WO | 00/37766 | 6/2000 | E21B/29/00 |
| WO | 00/37773 | 6/2000 | E21B/43/10 |
| WO | 02/25056 | 3/2002 | E21B/33/14 |
| WO | 02/081863 | 10/2002 | E21B/43/10 |

OTHER PUBLICATIONS

Bourgoyne, Jr. et al, Applied Drilling Engineering, Society of Petroleum Engineers, 1986, p. 428.*

* cited by examiner

*Primary Examiner*—Frank Tsay
(74) *Attorney, Agent, or Firm*—Moser Patterson & Sheridan

(57) ABSTRACT

A method of coupling first and second tubulars (12,14) comprises providing a first tubular having a first yield strength and a second tubular having a higher second yield strength. A portion of the first tubular is located within and overlapping a portion of the second tubular and the first tubular is expanded sufficient to expand the second tubular, at least the first tubular being expanded beyond its yield point. Following expansion, a degree of elastic contraction of the tubulars is permitted, sufficient to provide interference between the tubulars.

40 Claims, 3 Drawing Sheets

TUBING EXPANSION

FIELD OF THE INVENTION

The present invention relates to tubing expansion. In particular, the invention relates to expansion of a first tubular within a larger diameter second tubular to provide interference between the tubulars.

BACKGROUND OF THE INVENTION

In the oil and gas exploration and extraction industry, well bores are lined with metal tubing. Typically, the majority of a well will be lined with tubing known as casing, while the distal end of the well is provided with smaller diameter tubing known as liner. Generally, the section of the well provided with the liner will intersect the hydrocarbon-bearing formation. The liner may be suspended from the lower end of the casing by means of a liner hanger.

Conventionally, the liner hanger is a tubular assembly which is mounted on the upper end of the liner. The hanger is run into the casing with the liner and then configured first to engage and then to seal with the casing inner surface.

There is an undesirable loss of liner internal diameter associated with the provision of conventional liner hangers, and this is one reason behind the development of alternative hanger arrangements, such as proposed in WO99\18328 (Bailey et al). The disclosed hanger arrangement is achieved by expanding the upper end of the liner within a larger diameter casing, with a tubular spacer located therebetween. The liner, casing and spacer are of similar material. The liner is expanded past its yield point sufficiently to expand the spacer and the casing, with the intention that, following release of the expansion force, the elastic recovery of the liner is less than the elastic recovery for the casing. It is suggested that this provides for interference between the expanded liner, spacer and casing, sufficient to provide the necessary hanging support for the liner.

It is among the objectives of embodiments of the invention to provide a method and apparatus for use in forming a liner hanger which will provide a secure and reliable coupling between the liner and casing.

SUMMARY OF THE INVENTION

According to a first aspect of the present invention there is provided a method of coupling first and second tubulars, the method comprising:

providing a first tubular of a first diameter and having a first yield strength;

providing a second tubular of a second diameter greater than said first diameter and having a second yield strength greater than said first yield strength;

locating at least a portion of the first tubular within and overlapping with at least a portion of the second tubular;

expanding said portion of the first tubular sufficient to expand said portion of the second tubular, at least the first tubular being expanded beyond its yield point; and permitting at least a degree of elastic contraction of the tubulars sufficient to provide interference between the tubulars.

According to a second aspect of the present invention there is provided a method of coupling first and second tubulars, the method comprising:

providing a first tubular of a first diameter and having a first modulus of elasticity;

providing a second tubular of a second diameter greater than said first diameter and having a second modulus of elasticity lower than said first modulus of elasticity;

locating at least a portion of the first tubular within at least a portion of the second tubular;

expanding said portion of the first tubular sufficient to expand said portion of the second tubular; and permitting at least a degree of elastic contraction of the tubulars sufficient to provide interference between the tubulars.

The invention also relates to apparatus for use in implementing the methods.

In both aspects of the present invention, selection of the properties of the tubulars facilitates provision of interference between the tubulars; the elastic recovery of the outer second tubular will be greater than the elastic recovery of the inner tubular. Earlier proposals have suggested that this effect may be achieved using tubulars formed of similar materials. However, where similar materials are utilised, this effect is less easily achieved, and in some cases may result in minimal or even no coupling between the tubulars. It is believed that this problem may have been disguised in prior proposals by the provision of elastomeric seals and the like between the tubulars; the poor coupling between the tubulars themselves may not have been apparent due to the coupling effect provided by the expanded seals.

These aspects of the invention have particular utility in downhole applications, where the tubulars, such as liner and casing, may be coupled to provide a hanger for the first tubular. In such applications it is of course preferred that the interference between the tubulars is sufficient to provide hanging support for the first tubular, and furthermore that the interference between the tubulars is such that a fluid seal is provided between the tubulars.

Preferably, the second tubular is expanded to or beyond its yield point, this being particularly advantageous in respect of the first aspect. To ensure that the second tubular is expanded beyond its yield point, the degree of expansion may be selected to accommodate variables which may impact on the expansion process, such as variations in tubular wall thickness; API specifications permit a degree of variation in tubular wall thickness which would make it difficult to guarantee a specific degree of expansion, unless higher specification or specially manufactured or machined tubulars were utilised. Thus, it may be known that the wall thicknesses of the tubulars may vary by plus or minus 10%, such that the degree of expansion is selected to be high enough to ensure that one or preferably both of the tubulars will pass through yield.

Preferably, in the second aspect, as in the first aspect, the first tubular is expanded to or beyond its yield point, such that the tubular is subject to plastic deformation which is retained following elastic recovery.

Each tubular may have substantially constant material properties over its length. Alternatively, said portion may feature different material properties than the remainder of the tubular. Thus, for example, a second tubular may be provided which is formed substantially of a steel-based alloy, with only an end portion formed of a relatively expensive low modulus titanium alloy, or a material having a higher yield strength than the steel-based alloy.

The material properties, that is the yield strength or elastic or Young's modulus, of the tubulars may be substantially constant across the thickness of the tubular walls. Alternatively, the material properties may vary across the thickness of the tubular walls. This may be achieved by a number of means, for example selective localised heat treatment of a portion of the tubular wall. In other examples, the tubular wall may comprise two or more different materials, for example the tubular wall may incorporate bands of different materials having different properties. The different materials may be integral or may be present as separate members. In one embodiment a ring or sleeve of relatively high yield strength or low modulus may be provided externally of an otherwise conventional second tubular. Thus embodiments of the invention may be provided utilising substantially conventional tubulars, which may even be of the same material, by providing a close-fitting ring or band of a material such as titanium around the second tubular.

The tubulars may be expanded by any appropriate method, including forcing an expansion swage, cone or mandrel through the tubulars, or applying an elevated hydraulic pressure to the inner diameter of the first tubular, or a combination of both. The swage or cone may take any appropriate form, and may include rolling or low friction surfaces to facilitate translation of the expansion device through the tubulars. Such expansion induces circumferential stretching or strain in the tubulars. For such mechanisms, it is important that the second tubular is free to expand, preferably to and beyond yield, and in downhole applications of the invention this may require that the annulus surrounding the second tubular is not filled by incompressible material, such as set cement or a part of the bore wall which would restrict or prevent any such expansion. An arrangement for facilitating provision of such an annulus is described in applicant's PCT/GB01/04202, the disclosure of which is incorporated herein by reference. Such an arrangement may be provided in combination with the present invention. However, in some circumstances it may be difficult if not impossible to guarantee that the annulus is or remains clear, or that some other variable will impact on the ability to expand the second tubular to the desired extent. In such cases it may be desirable to provide an expansion device having a degree of compliance, that is a device which will normally expand the tubulars to the desired, predetermined extent, but which is capable of accommodating reductions in the degree of expansion, as may occur if the wall of one or both of the tubulars was unusually thick or if there was a reduction in bore diameter due to a swelling formation. In the absence of such compliance, a fixed diameter expansion cone or swage would be unable to pass through the restriction, and could become stuck fast at the restriction. Most preferably, the degree of compliance built into the cone or swage is such that the minimum degree of expansion provided by the swage is sufficient to expand the first tubular through yield.

Alternatively, or in addition, it may be possible to expand the tubulars utilising a rolling or rotary expansion device, which may or may not be compliant, such as the various expansion devices which are available from the applicants, and as described in WO00\37766 and U.S. Ser. No. 09\469,690, the disclosures of which are incorporated herein by reference.

Spacing, sealing or gripping members may be provided on one or both of the tubulars, or for location between the tubulars. The sealing members may include elastomeric rings or sleeves, or bands of formable material, such as relatively soft metal such as lead or bronze. The gripping members may include slips or teeth of relatively hard material, or elements of relatively hard material, such as tungsten carbide, that will bite into the opposing surfaces of the tubulars. However, it is believed that the degree of interference provided by the present invention is such that, for the majority of applications, no such seals or spacers will be required, and that the first tubular will be in direct contact with the second tubular.

The yield strength of the first tubular is preferably selected to be lower than the yield strength of the second tubular before any expansion or deformation has taken place. However, it is more important that the yield strength of the first tubular is lower than the yield strength of the second tubular at the point when deformation of the second tubular is initiated, most preferably on first contact between the tubulars. For example, it may be proposed to utilise a low yield point highly ductile alloy steel first tubular in a situation where significant clearance is to be provided between the unexpanded tubular and the casing or second tubular through which the expandable tubular is run, to allow for fluid bypass when running into the well bore. Thus, in order to engage the casing, the expandable first tubular would have to be expanded a considerable way beyond its yield point before the tubular makes contact with the surrounding casing. In the process of expansion the material properties of the inner tubular change due to the material being cold worked; the yield point will increase, with the possibility of the yield point becoming higher than the yield point of the outer casing. In the event that this does occur, there is the possibility that minimal or even no interference will be established between the tubulars, even if both are then further expanded past yield. Another aspect of the invention therefore relates to determining the yield point of a first tubular at the point expansion of the second tubular will be initiated. On the basis of this information, it can be determined whether a spacer or other coupling mechanism is required between the first and second tubulars. Similarly, further aspects of the invention relate to determining a material property of a tubular and then selecting a further tubular having the material properties necessary to achieve an appropriate level of interference therebetween, or simply to determining the suitability for coupling of two tubulars. The determination of suitability may be carried out using any appropriate method, including finite element analysis (FEA).

For the first aspect, the materials utilised to form the tubulars may have the same or similar elastic moduli.

Of course the aspects of the invention may be combined, that is by providing a second tubular with a greater yield strength and a lower modulus of elasticity.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
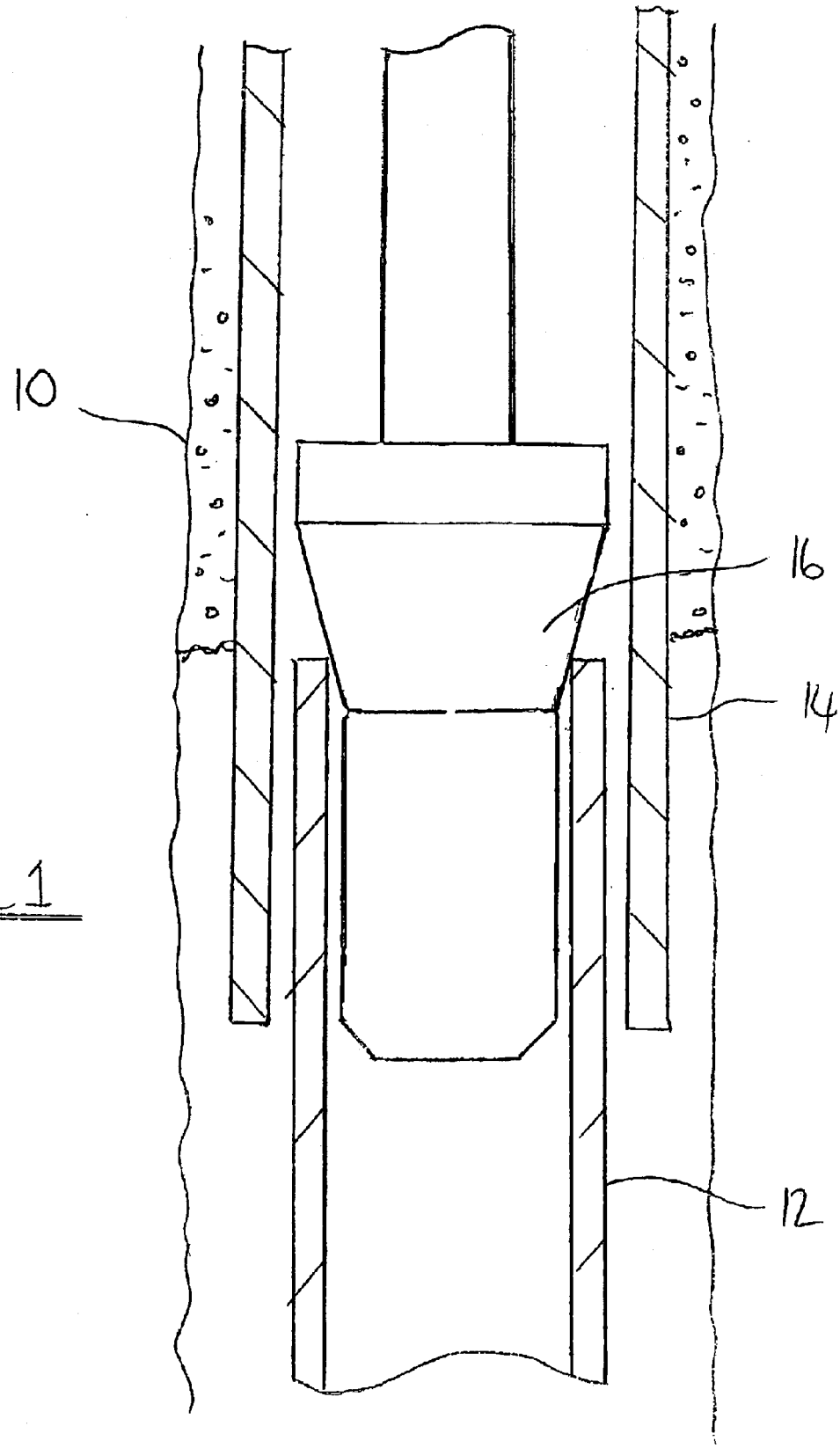
FIGS. 1 and 2 are schematic sectional views of steps in creating a liner hanger in accordance with an embodiment of the present invention.

Reference is first made to FIG. 1 of the drawings, which illustrates a section of a drilled bore 10 into which a first tubular, in the form of a liner 12, has been run, with the upper end of the liner 12 overlapping the lower end of a second tubular, in the form of existing casing 14.

The liner 12 has an outer diameter smaller than the inner diameter of the casing 14, to allow the liner 12 to be run through the casing.

An expansion device, in this example a conical swage 16, has been run into the bore with the liner 12, and is run through at least the upper end portion of the liner 12. The degree of expansion is such that the outer face of the liner 12 contacts the inner face of the casing 14 and expands the casing 14; the annulus surrounding the lower end of the casing has been left free of cement, to permit expansion of the casing. The degree of expansion of the liner 12 is further selected such that the liner 12 experiences an expansion force in excess of its yield strength, that is the liner 12 is subject to permanent plastic deformation.

Figure 2:
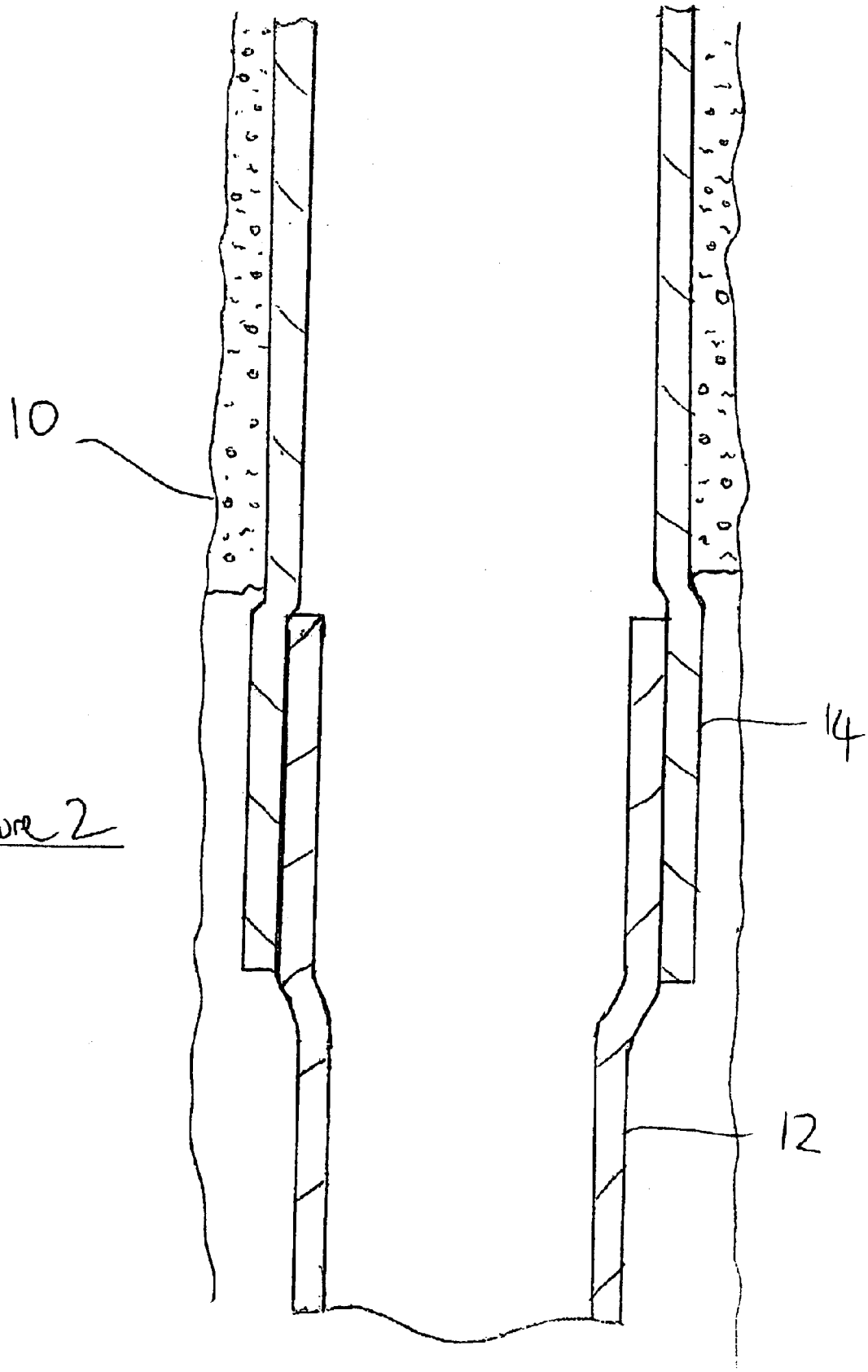

After the expansion device 16 has passed through the overlap between the liner 12 and casing 14, as illustrated in FIG. 2, the tubulars 12, 14 experience a degree of elastic recovery. To provide an appropriate level of contact stress and interference, the degree of elastic recovery of the casing 14 is greater than that of the liner 12. This is achieved by selecting a casing material having one or both of a lower modulus of elasticity and higher yield strength than the liner material.

EXAMPLE 1

In a first example, the casing 14 is of titanium alloy, with a Young's modulus (E) of elasticity of $15–17\times10^6$ psi. The liner 12 is of a A106 Grade B steel, having a modulus of $29–30\times10^6$ psi (180–210 GPa). Following expansion, the degree of elastic recovery of the casing 14 is of the order of twice the degree of recovery of the liner 12, with the result that there is significant contact stress (2,830 psi) between the liner 12 and casing 14, leading to the creation of a secure, fluid tight hanger.

EXAMPLE 2

In a second example, the liner 12 is in the form of A106 Grade B line pipe with a yield strength of 46,500 psi, while the casing 14 is in the form of L80 casing with a yield strength of 98,500 psi. The initial outside diameter of the liner 12 and the inside diameter of the casing 14 are both approximately 7 ⅝", and both have a wall thickness of ⅜".

The degree of expansion was selected such that both the liner 12 and casing 14 experienced stress 10% above their yield positions.

Once the expansion force is removed, and the tubulars 12, 14 are permitted to relax, a contact stress of 2400–2500 psi (determined by FEA) is created between the tubulars due to the differential elastic recovery of the liner 12 and casing 14. This level of stress is sufficient to permit the liner to be hung from the casing 14 and, assuming the contacting surfaces are reasonably smooth, creates a fluid-tight seal between the tubulars, obviating the requirement for elastomeric seals.

COMPARATIVE EXAMPLE 3

In this comparative example, the same materials and tubular dimensions as described in Example 2 were utilised, however the materials were reversed, that is the liner 12 was formed of L80 line pipe and the casing 14 of the lower yield A106 Grade B line pipe.

As with Example 2, the degree of expansion was selected such that both the liner 12 and casing 14 experience stress 10% above their yield points.

Following expansion, the greater elastic recovery of the higher yield strength liner 12 was found to result in a small (0.005") radial annular gap appearing between the liner 12 and the casing 14.

It will thus be apparent to those of skill in the art that the appropriate determination and selection of material properties, as taught by the present invention, is important in achieving a secure and reliable coupling between expanded tubulars. In other aspects of the invention material properties other than yield strength and elastic modulus may be determined and selected with a view to ensuring that a secure coupling is achieved.

Figure 3:
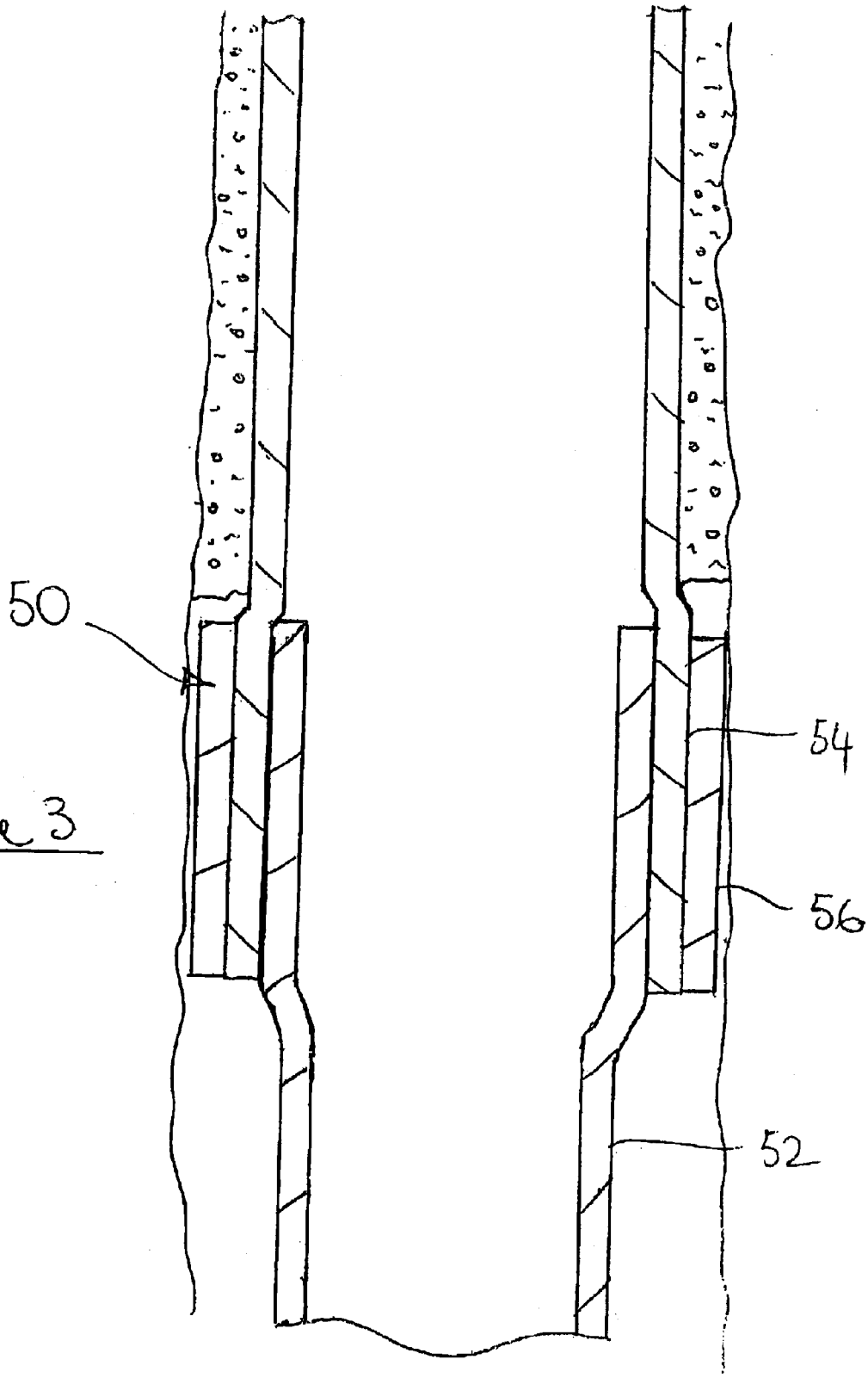
FIG. 3 is a sectional schematic view of a liner hanger in accordance with a further embodiment of the present invention.

Reference is now made to FIG. 3 of the drawings, which is a sectional schematic view of a liner hanger 50 in accordance with a further embodiment of the present invention. The liner hanger 50 is created in a similar manner to the hanger described above with reference to FIGS. 1 and 2. However, in this example the liner 52 and the casing 54 are formed of similar materials having similar material properties, such as an appropriate steel. To ensure the creation of a secure interference coupling between the tubulars 52, 54, the expansion behaviour of the lower end of the casing 54 is modified by fitting a band 56 of titanium alloy around the casing 54. Thus, the composite portion of the casing 54, 56 will experience a greater degree of elastic recovery than the liner 52 following expansion, to create a secure and fluid-tight coupling between the liner 52 and the casing 54.

This embodiment offers the advantage that sections of tubular of the same or similar properties may be used to line well bore in accordance with embodiments of the invention, with the expansion properties of localised portions of the tubular sections being modified simply by providing a relatively short band or ring of an appropriate material around the portion of tubular which will form the outer tubular at the coupling between the sections.

Those of skill in the art will appreciate that the above described embodiments are merely exemplary of the present invention and that various modifications and improvements may be made thereto, without departing from the scope of the invention. For example, in the above described examples it is assumed that expansion occurs due to substantially uniform deformation or extension of the tubulars walls, however in other embodiments the deformation may be non-uniform or may be limited to selected portions of the bore wall; the expansion may be as a result of circumferential extension of only a part of the wall of one or both of the tubulars, the expansion may result in the creation of a non-circular form, and indeed one or both of the tubulars may initially be non-circular.

In other embodiments, the coupling between the liner and casing may be formed by following a different sequence of events. For example, liner may be run through casing and then the upper end of the liner expanded below the casing to an inner diameter larger than the outer diameter of the lower end of the casing. The liner may then be lifted such that the expanded upper end of the liner surrounds the lower end of the casing. The lower end of the casing is then expanded into contact with the previously expanded upper end of the liner.

What is claimed is:

1. A method of coupling first and second tubulars, the method comprising:

providing a first tubular constructed of a first material having a first material property;

providing a second tubular constructed of a second material having a second material property greater than said first material property;

locating an end portion of the first tubular within an overlapping end portion of the second tubular;

expanding at least a portion of said end portion of the first tubular sufficient to expand a surrounding portion of the second tubular, the expanded portions of the first tubular being expanded beyond its yield point; and then permitting at least a degree of relaxation of the surrounding portion of the second tubular.

2. The method of claim 1, wherein:

each of the first and second material properties is yield strength;

the step of expanding at least a portion of the first tubular comprises expanding said portion of the first tubular by application of a radial expansion force thereto;

the surrounding portion of the second tubular is expanded at least to its yield point; and the step of permitting at least a degree of relaxation of the surrounding portion of the second tubular comprises reducing said expansion force to permit said degree of relaxation of the surrounding portion of the second tubular.

3. The method of claim 2, wherein the step of expanding at least a portion of the first tubular occurs downhole.

4. The method of claim 3, wherein the first tubular is part of a liner string.

5. The method of claim 3, wherein:

the second tubular is part of a casing string; and the liner string is hung off of the casing string as a result of the expansion of the first tubular.

6. The method of claim 2, wherein the step of expanding at least a portion the first tubular produces a fluid seal between the expanded portion of the first tubular and the surrounding relaxed portion of the second tubular.

7. The method of claim 2, wherein the surrounding portion of the second tubular is expanded beyond its yield point before it is relaxed.

8. The method of claim 2, wherein the step of expanding the first tubular is accomplished by forcing an expansion cone through the first tubular.

9. The method of claim 2, wherein the step of expanding the tubulars is accomplished by rolling expansion.

10. The method of claim 2, wherein the step of expanding the tubulars is accomplished by using a compliant expander device.

11. The method of claim 2, comprising selecting the yield strength of the first tubular to be lower than the yield strength of the second tubular at the point deformation of the second tubular is initiated.

12. The method of claim 2, further comprising:

selecting the materials utilised to form the tubulars such that the first tubular has a greater modulus of elasticity than the second tubular.

13. The method of claim 2, wherein:

the first tubular is part of a liner string;

the second tubular is also part of a liner string; and the first liner string is hung off of the second liner string as a result of the expansion of the first tubular.

14. The method of claim 2, wherein:

the first tubular is part of a production tubing string;

the second tubular is part of a liner string; and the tubing string is sealingly engaged with the surrounding liner string as a result of the expansion of the first tubular.

15. The method of claim 2, wherein the second tubular has substantially constant material properties over its length.

16. The method of claim 2, wherein at least at least a portion of the surrounding second tubular has different material properties from another portion of the second tubular.

17. The method of claim 16, wherein said portion of the second tubular comprises inner and outer wall portions of different material properties.

18. The method of claim 17, wherein:

said inner and outer well portions comprise separate members;

said inner wall portion is fabricated from a steel material; and said outer wall portion defines one or more bands of titanium alloy.

19. The method of claim 1, comprising maintaining an annulus surrounding said portion of the second tubular free of material that would restrict the desired degree of expansion of the tubulars.

20. The method of claim 1, comprising selecting the yield strength of the first tubular to be lower than the yield strength of the second tubular before expansion of the tubulars.

21. A method of coupling a first tubular with a second tubular, the method comprising:

determining the yield strength of a second material that a second tubular is constructed from;

selecting a first tubular constructed of a first material having a yield strength less than said determined second yield strength;

locating at least a portion of the first tubular within and overlapping at least a portion of the second tubular;

expending said portion of the first tubular sufficient to expand said portion of the second tubular, at least the first tubular being expanded beyond its yield point; and permitting at least a degree of elastic relaxation of the tubulars, the degree of relaxation of the second tubular being greater than the degree of relaxation of the first tubular.

22. A method of coupling first and second tubulars, the method comprising:

providing a first tubular constructed of a first material having a first modulus of elasticity;

providing a second tubular constructed of a second material having a second modulus of elasticity lower than said first modulus of elasticity;

locating at least a portion of the first tubular within at least a portion of the second tubular;

radially expanding said portion of the first tubular by application of an expansion force sufficient to expand a surrounding portion of the second tubular as well; and reducing said expansion force to permit at least a degree of elastic contraction of the surrounding portion of the second tubular to enhance the interference fit between the first and second tubulars.

23. The method of claim 22, wherein the step of radially expanding the tubulars is accomplished downhole.

24. The method of claim 23, wherein the first tubular is part of a liner string.

25. The method of claim 24, wherein:

the second tubular is part of a casing string; and the interference fit between the first and second tubulars allows for the hanging of the liner string from the casing string.

26. The method of claim 25, the interference fit also forms a fluid seal between the tubulars.

27. The method of claim 25, wherein the first tubular has a first yield strength and the second tubular has a second yield strength, the second yield strength being greater than said first yield strength.

28. The method of claim 22, comprising expanding the first tubular at least to its yield point.

29. The method of claim 22, comprising expanding the first tubular beyond its yield point.

30. The method of claim 22, comprising expanding the second tubular at least to its yield point.

31. The method of claim 22, comprising expanding the second tubular beyond its yield point.

32. The method of claim 22, comprising expanding the tubulars using a compliant expander device providing minimum degree of expansion sufficient to expand the first tubular through yield.

33. The method of claim 22, comprising maintaining an annulus surrounding said portion of the second tubular free of material that would restrict the desired degree of expansion of the tubulars.

34. The method of claim 22, comprising selecting the yield strength of the first tubular to be lower than the yield strength of the second tubular.

35. The method of claim 22, wherein the second tubular has substantially constant material properties over its length.

36. The method of claim 22, wherein at least a portion of the surrounding second tubular has different material properties from another portion of the second tubular.

37. The method of claim 36, wherein said portion of the second tubular comprises inner and outer wall portions of different material properties.

38. The method of claim 37, wherein said outer wall portion has a modulus of elasticity lower than said inner wall portion.

39. The method of claim 37, wherein said inner and outer wall portions are integral.

40. The method of claim 37, wherein:

said inner and outer wall portions comprise separate members;

said inner well portion is fabricated from a steel material; and said outer wall portion defines one or more bands of titanium alloy.

* * * * *